US007424749B2

(12) United States Patent
McCloskey et al.

(10) Patent No.: US 7,424,749 B2
(45) Date of Patent: Sep. 16, 2008

(54) DISPOSABLE DRIBBLE BIB

(75) Inventors: Edward McCloskey, Drogheda (IE); Susanne McCloskey, Drogheda (IE)

(73) Assignee: Edmak Limited, Drogheda, County Louth (IE)

( * ) Notice: Subject to any disclaimer, the term of this patent is extended or adjusted under 35 U.S.C. 154(b) by 0 days.

(21) Appl. No.: 11/905,261

(22) Filed: Sep. 28, 2007

(65) Prior Publication Data

US 2008/0022429 A1 Jan. 31, 2008

Related U.S. Application Data

(63) Continuation of application No. 11/653,272, filed on Jan. 16, 2007, now abandoned, which is a continuation of application No. 11/302,212, filed on Dec. 14, 2005, now abandoned, which is a continuation of application No. 10/383,767, filed on Mar. 10, 2003, now abandoned.

(30) Foreign Application Priority Data

Mar. 8, 2002 (IE) ..... 52002-0182

(51) Int. Cl.
*A41B 13/10* (2006.01)

(52) U.S. Cl. ..... 2/49.1; 2/46

(58) Field of Classification Search ..... 2/49.1, 2/48, 46, 49.2–49.5, 50, 51, 52, 47, 53, 56, 2/60, 80, 111, 75, 69, 456, 118, 119, 174, 2/206, 207, 243.1; D2/860–864; 24/7, 8; 128/849, 888, 889; 442/320, 408; 428/85, 428/90, 91, 92, 100

See application file for complete search history.

(56) References Cited

U.S. PATENT DOCUMENTS

| | | | | |
|---|---|---|---|---|
| 2,852,778 | A * | 9/1958 | Berl | 2/48 |
| 3,016,544 | A | 1/1962 | Pinkney | |
| 3,093,829 | A | 6/1963 | Maine | |
| 3,837,995 | A | 9/1974 | Floden | |
| 3,916,447 | A | 11/1975 | Thompson | |
| 4,174,542 | A | 11/1979 | Vistins | |
| 4,787,099 | A | 11/1988 | Mack | |
| 5,062,158 | A | 11/1991 | Oka et al. | |
| D341,922 | S | 12/1993 | Stocks | |
| 5,718,589 | A | 2/1998 | McCracken et al. | |
| H1738 | H | 7/1998 | Reinhart, Jr. | |
| 6,047,402 | A | 4/2000 | Chester-Salter | |
| 6,212,683 | B1 | 4/2001 | Liebmann | |
| 6,617,487 | B2 | 9/2003 | Chou et al. | |
| 2002/0188998 | A1 | 12/2002 | Yost | |

* cited by examiner

*Primary Examiner*—Amy B Vanatta
(74) *Attorney, Agent, or Firm*—Birch Stewart Kolasch & Birch, LLP

(57) ABSTRACT

A disposable dribble bib for babies comprises a shaped panel of non-woven cotton material. The bib has an outer face and an inner face each of which has a hairy surface formed by cotton fibers which when the bib is placed on a garment will attach and hold the bib on the garment. The bib is simple and cheap to manufacture and is double sided, that is it can be used either way round with either the outer face or inner face engaging the garment. A neck-receiving recess is provided at an upper end of the bib.

6 Claims, 2 Drawing Sheets

DISPOSABLE DRIBBLE BIB

CROSS-REFERENCE TO RELATED APPLICATION

The present application is a continuation of U.S. patent application Ser. No. 11/653,272 filed on Jan. 16, 2007 now abandoned, which is a continuation of Ser. No. 11/302,212 filed on Dec. 14, 2005, now abandoned which is a continuation of U.S. patent application Ser. No. 10/383,767 filed Mar. 10, 2003, now abandoned which claims priority under 35 U.S.C. § 119 to Irish Patent Application No. 52002/0182, filed Mar. 8, 2002, the entire contents of which are hereby incorporated by reference.

BACKGROUND OF THE INVENTION

1. Field of the Invention

This invention relates to a disposable dribble bib for very young babies which are typically no more than six months old.

2. Description of Background Art

Different types of cloth and plastics bibs are widely available, particularly for older babies and toddlers to protect their garments when they are feeding. Examples in the prior art include U.S. Pat. Nos. 6,070,268, 4,620,323, 3,979,776 and 3,871,027. However, many of these bibs are not really suitable for very young babies—say up to six months old—as they may be too large, difficult to tie about the baby's neck or of relatively coarse material which would be uncomfortable for very young babies.

In U.S. Pat. No. 3,916,447 there is disclosed a composite protective covering having an outer absorbent layer of cellulosic fibres bonded onto an inner layer of synthetic polymer microfibres which tend to self-attach to fabric materials when the inner layer of the covering is laid up on the fabric material. Another self-adhesive disposable cover such as a bib is disclosed in GB 2293959. In this case self-adhesive strips are provided on an inner face of the bib for attachment of the bib to clothing. A further bib is disclosed in GB 2285570 which uses adhesive for attachment to clothing. In WO 02/094043 there is disclosed a bib which is secured to clothing in use by adhesive tape or Velcro (Registered Trade Mark). In a bib disclosed in U.S. Pat. No. 6,256,788 the whole of the inside face of the bib is coated with adhesive for attachment to clothing. All of these bibs are used one way only, that is with the inner face which includes the attachment means secured to the clothing. This may present difficulties when fitting the bib on a baby's clothing which is typically a one-handed operation whilst holding the baby in the other arm, it often being difficult to hold the baby still. Further, many of the currently available bibs are of composite construction including a number of superimposed layers of material and so are relatively expensive to produce.

The present invention is directed towards overcoming these problems.

SUMMARY AND OBJECTS OF THE INVENTION

According to the invention there is provided a disposable dribble bib for mounting directly beneath a baby's chin on clothing covering the baby's chest, the bib including a panel of liquid absorbing material, means for releasable self-attachment of the panel to clothing worn by the baby to retain the bib in position on the baby in use, the bib panel being formed from a substantially homogenous non-woven cotton material, said bib panel having an inner face and an outer face which are similar, each of said inner face and outer face having a surface which is sufficiently hairy to form the means for releasable self-attachment of the panel to clothing worn by the baby.

Advantageously the bib is simply placed on the baby's clothing to which it will hold itself during use. The faces of the panel have a nap surface, a hairy or downy surface so that each face will self-attach to the baby's clothing to retain the bib in position during use and yet can be readily easily removed after use. As it is double sided it can be used either way round making it easy to fit. Further as the bib is produced from substantially homogenous non-woven cotton material it is relatively cheap and simple to produce.

In a particularly preferred embodiment the panel is formed of hydroentangled cotton material. This is very absorbent and is soft and comfortable for a baby.

In another embodiment a scalloped neck-receiving recess is provided at an upper end of the bib. Preferably the recess is centrally located between opposite sides of the panel. This allows the bib to be fitted snugly about a baby's neck during use.

In a further embodiment a tongue flap is provided at the bottom end of the bib. Conveniently a tongue flap may be provided which corresponds in shape to the scalloped recess at the upper end of the bib. This facilitates simple and cheap manufacture of the bib as described later.

In another embodiment a scalloped neck-receiving recess is provided at both a top and at a bottom of the panel. This provides additional reversibility. Indeed if desired a scalloped neck-receiving recess may be provided at a top and a bottom and at each side of the panel, again for ease of fitting in any desired orientation whichever way the bib is facing.

In another embodiment there is provided a disposable dribble bib for mounting directly beneath a baby's chin on clothing covering the baby's chest, the bib including a panel of liquid absorbing material, means for releasable self-attachment of the panel to clothing worn by the baby to retain the bib in position on the baby in use, the bib panel being formed from a substantially homogenous non-woven cotton material having a hairy surface for releasable self-attachment to the clothing.

In another aspect the invention provides a pack of disposable bibs of the type described herein comprising a plurality of the bibs in a package or carton. Conveniently the bibs may be stacked or arranged in a row face to face within the packaging.

In another aspect of the invention there is provided a method of manufacturing a bib of the type described herein comprising the steps of forming a web of non-woven cotton material, delivering a leading end of the web to a cutter, and cutting away a bib from a leading end of the web. Preferably the cutter is shaped for simultaneously cutting away the bib whilst forming one end of the bib and the opposite end of the next bib at a leading edge of the web. Thus advantageously there is minimal or no waste.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will be more clearly understood by the following description of some embodiments thereof, given by way of example only, with reference to the accompanying drawings, in which.

DETAILED DESCRIPTION OF THE PREFERRED EMBODIMENTS

Figures 1, 2, 3:
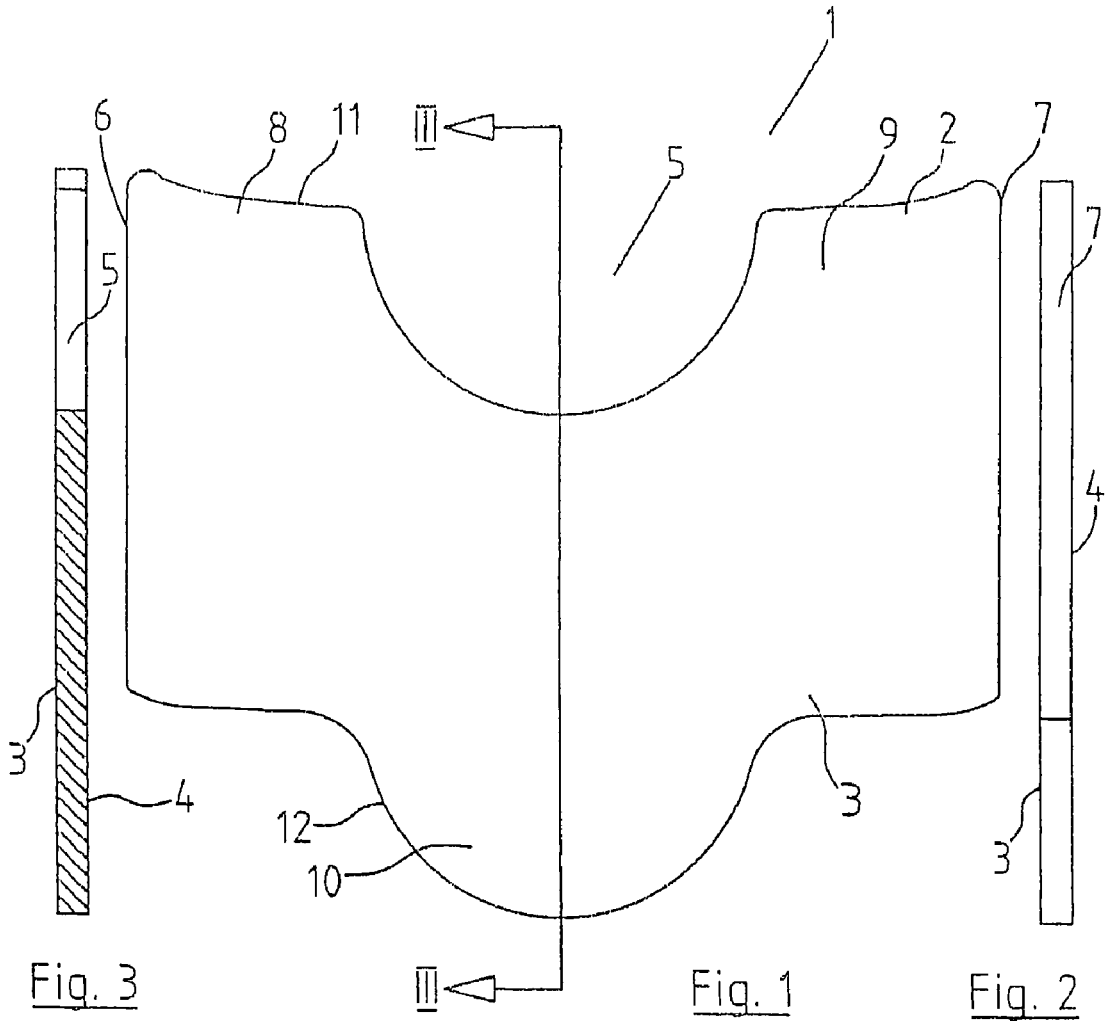
FIG. 1 is an elevational view of a disposable baby's bib according to the invention.
FIG. 2 is an end elevational view of the bib.
FIG. 3 is a sectional view of the bib taken along the line III-III of FIG. 1.

FIGS. 1-3 illustrate a disposable baby's bib according to the invention indicated generally by the reference numeral 1. The bib 1 comprises a shaped panel 2 of liquid-absorbing non-woven hydroentangled cotton material. In this case the bib 1 is double sided, that is it can be used either way around with both an outer face 3 and an inner face 4 having a hairy surface formed by cotton fibres which when the bib 1 is placed against a garment will attach itself and hold the bib 1 on the garment.

A scalloped neck-receiving recess 5 is provided at an upper end of the bib 1 centrally located between opposite sides 6, 7 of the panel 2. The recess 5 is sized to accommodate the neck of a baby with side flaps 8, 9 of the panel 2 locating at each side of the baby's neck.

A tongue flap 10 is provided at a bottom end of the bib 1. This may conveniently be used to wipe clean the baby's mouth and chin, during feeding with a bottle for example.

Figure 4:
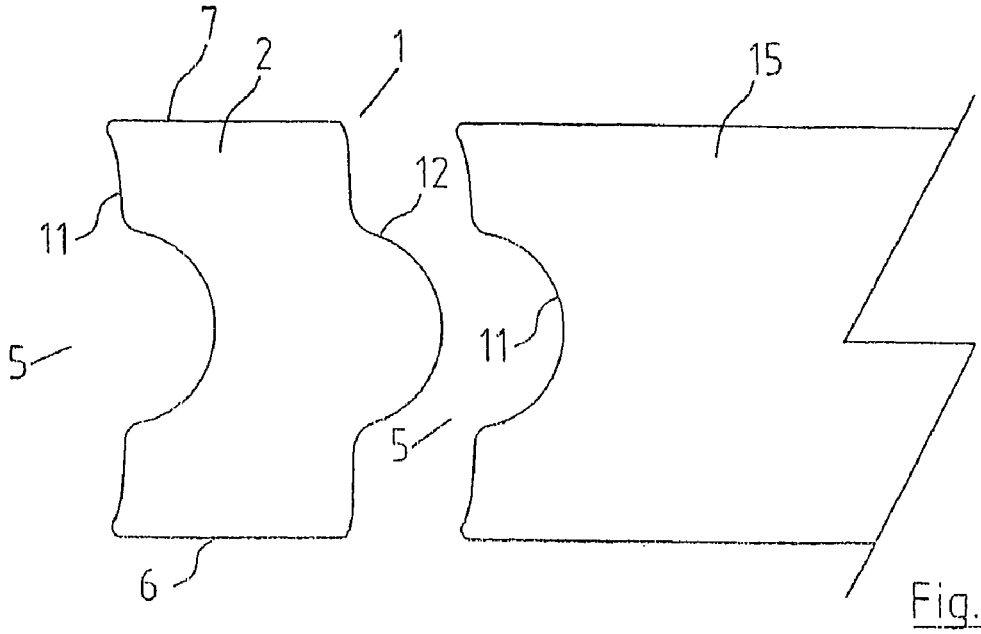
FIG. 4 is a plan view illustrating manufacture of the bib by cutting the bib away from a carded cotton web.

It will be noted that a top edge 11 of the bib 1 incorporating the recess 5 has a profile which exactly corresponds to a bottom edge 12 which incorporates the tongue 10. This facilitates cheap and easy manufacture, as shown in FIG. 4. A web 15 of carded cotton material is formed and delivered to a cutter at which at cutter blade cuts through the web 15 between opposite sides of the web 15 to form the common profile of the top edge 11 and bottom edge 12 of the panel 2, cutting away a bib 1 from a leading end of the web 15, forming the profiled bottom edge 12 of the bib 1 and simultaneously forming the profiled upper edge 11 with the recess 5 at the leading end of the web 15 for the next bib 1 to be cut away from the web 15.

In use, typically a plurality of the bibs 1 are provided in a package or a carton (not shown). A user takes a bib 1 and places the bib 1 directly beneath a baby's head on the baby's chest with the baby's neck engaged within the recess 5. The hairy or downy surface of the inside face 4 of the bib 1 grips and attaches the bib 1 to the baby's clothing to keep the bib 1 in position during use. Any dribbling or spillage during feeding of the baby with a bottle for example is absorbed by the material of the panel 2 to protect the baby's clothing. It will be noted that the hydroentangled cotton material is very soft and therefore will not irritate or cause discomfort to the baby. After use, the bib 1 is simply peeled away from the baby's clothing and discarded.

It will be appreciated that the invention provides a highly absorbent disposable bib which is relatively cheap and simple to manufacture.

Figure 5:
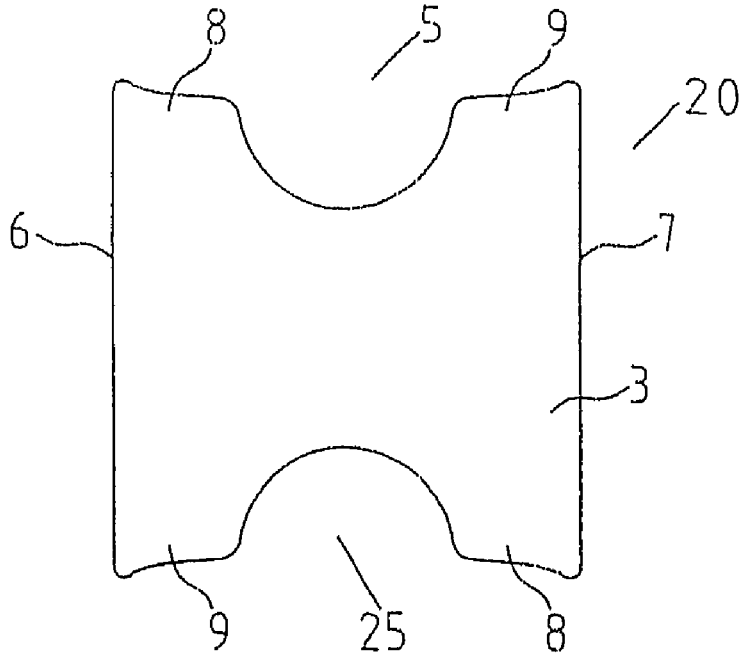
FIG. 5 is an elevational view of a disposable baby's bib according to another embodiment of the invention.
Figure 6:
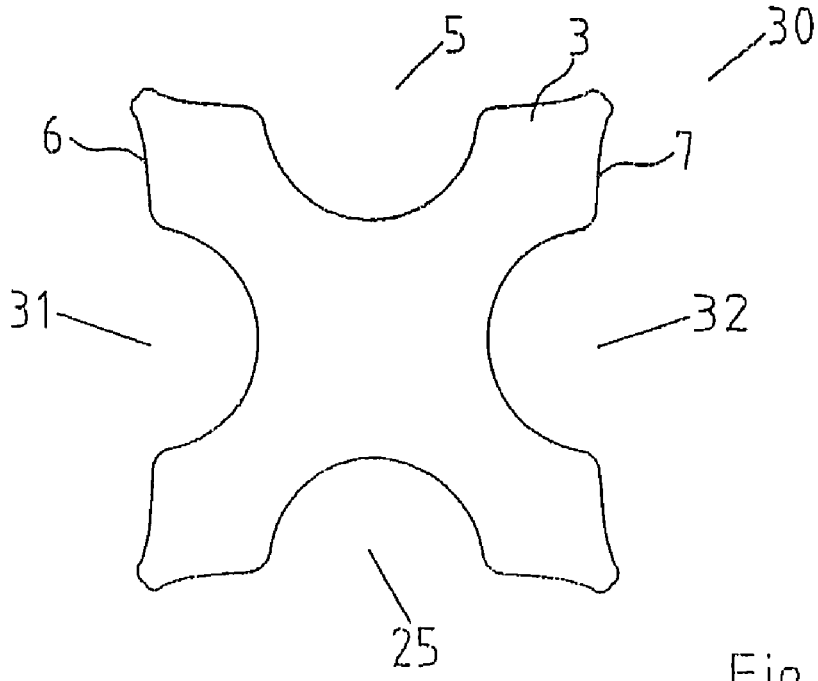
FIG. 6 is an elevational view of a disposable baby's bib according to still another embodiment of the invention.

While the bib design illustrated is particularly convenient for manufacture in that only one cutting blade is required to cut away the bibs from the web the bib could in fact be made in any suitable design in which for example the top and bottom edges of the bib have different profiles. In this regard other possibilities are shown in FIGS. 5 and 6. Parts similar to those described previously are assigned the same reference numerals. FIG. 5 shows a bib indicated generally by the reference numeral 20 which has an additional scalloped recess 25 at a bottom of the bib 20 so that the top and bottom of the bib are reversible. This further facilitates ease of fitting on a baby. FIG. 6 shows another bib indicated generally by the reference numeral 30. In this case additional scalloped recesses 31, 32 are provided at each side of the bib 30 for engagement with a baby's neck. Any of the recesses 5, 25, 31, 31 can be engaged with the baby's neck in use for ease of fitting the bib 30 on the baby.

While the scalloped recess ensures a snug fit about the baby's neck a less pronounced recess or a simply curved top edge might be provided which gives adequate protection. Indeed a rectangular bib is another possibility.

Regarding packaging, instead of cutting away bibs from the web to form separate bibs, the cutter may simply partially cut through the web so that a plurality of bibs are interconnected by easily frangible links. Thus the web could be wound in a roll or folded in zig-zag formation in a stack and a bib torn away from the free end for use as required.

The bibs of the invention are soft, hypo-allergenic and biodegradable.

The invention is not limited to the embodiments hereinbefore described which may be varied in both construction and detail within the scope of the appended claims.

The invention claimed is:

1. A disposable dribble bib for mounting directly beneath a baby's chin on clothing covering the baby's chest, the bib being of a substantially homogeneous non-woven cotton material, and including:

a panel of liquid absorbing cotton material, means for releasable self-attachment of the cotton bib panel to clothing worn by the baby to retain the cotton bib in position on the baby in use, said cotton bib panel having an inner face and an outer face which are similar, whereby the cotton bib panel is double sided so that either of the two faces of the cotton bib panel can face the clothing of the baby, each of said inner face and said outer face of the cotton bib panel having a hairy surface formed by cotton fibres which is sufficiently hairy to form the means for releasable self-attachment of the cotton bib panel to the clothing worn by the baby.

2. The disposable dribble bib as claimed in claim 1 wherein a scalloped neck-receiving recess is provided at an upper end of the bib, said recess being centrally located between opposite sides of the panel, and a tongue flap is provided at the bottom end of the bib, the tongue flap corresponding in shape to the scalloped recess at the upper end of the bib.

3. The disposable dribble bib as claimed in claim 1, wherein the cotton material of the panel is hydroentangled.

4. The disposable dribble bib as claimed in claim 1, wherein a scalloped neck-receiving recess is provided at an upper end of the bib and at a bottom end of the bib.

5. The disposable dribble bib as claimed in claim 1, wherein a scalloped neck-receiving recess is provided at an upper end of the bib, at a bottom end of the bib, and at each side of the bib.

6. A pack of disposable dribble bibs of the type claimed in claim 1, comprising a plurality of said bibs in a package or carton.

* * * * *